US007725311B2

(12) United States Patent
Bourokba et al.

(10) Patent No.: US 7,725,311 B2
(45) Date of Patent: May 25, 2010

(54) METHOD AND APPARATUS FOR RATE REDUCTION OF CODED VOICE TRAFFIC

(75) Inventors: Lakhdar Bourokba, Montreal (CA); Peter Yue, St. Laurent (CA)

(73) Assignee: Ericsson AB, Stockholm (SE)

( * ) Notice: Subject to any disclaimer, the term of this patent is extended or adjusted under 35 U.S.C. 154(b) by 829 days.

(21) Appl. No.: 11/536,261

(22) Filed: Sep. 28, 2006

(65) Prior Publication Data

US 2008/0082324 A1 Apr. 3, 2008

(51) Int. Cl.
*G10L 21/00* (2006.01)

(52) U.S. Cl. ..... 704/219; 704/221; 704/500; 375/240

(58) Field of Classification Search ..... 704/219, 704/221, 500; 375/240
See application file for complete search history.

(56) References Cited

U.S. PATENT DOCUMENTS

| | | | | |
|---|---|---|---|---|
| 5,519,779 | A | 5/1996 | Proctor et al. | |
| 6,678,654 | B2 * | 1/2004 | Zinser et al. | 704/221 |
| 6,829,579 | B2 | 12/2004 | Jabri et al. | |
| 7,318,027 | B2 * | 1/2008 | Lennon et al. | 704/229 |
| 7,433,815 | B2 * | 10/2008 | Jabri et al. | 704/203 |
| 2003/0028386 | A1 * | 2/2003 | Zinser et al. | 704/500 |
| 2003/0202475 | A1 | 10/2003 | Chen et al. | |
| 2005/0053130 | A1 * | 3/2005 | Jabri et al. | 375/240 |
| 2005/0159943 | A1 * | 7/2005 | Zinser et al. | 704/219 |

FOREIGN PATENT DOCUMENTS

WO WO 2005/006687 A1 1/2005

WO WO 2005/078707 A1 8/2005

OTHER PUBLICATIONS

Dr. Ernest Simo, CDMA Online, CDMA Interactive, Blank and Burst, http://www.cdmaonline.com/interactive04/workshops/terms1/1015.htm, 2004, 2 pages.

Dr. Ernest Simo, CDMA Online, CDMA Interactive, Dim and Burst, http://www.cdmaonline.com/interactive04/workshops/terms1/1019.htm, 2004, 2 pages.

3G, 3rd Generation Partnership Project 2, "3GPP2", Enhanced Variable Rate Codec, Speech Service Option 3 for Wideband Spread Spectrum Digital Systems, Version 1.0, Apr. 2004.

Kang et al "Improving the Transcoding Capability of Speech Coders" Multimedia, IEEE Transactions on, vol. 5, No. 1, pp. 24-33, Mar. 2003.

* cited by examiner

*Primary Examiner*—Daniel D Abebe

(57) ABSTRACT

A conversion entity and method for converting higher-rate speech parameters into lower-rate parameters including dimmed excitation parameters. The conversion entity comprises a first decoder configured to produce a target excitation from the higher-rate parameters, based on a first fixed contribution and a first adaptive contribution. The conversion entity also comprises a second decoder configured to produce a second adaptive contribution, and configured to selectably operate in a first or a second mode. In the first mode, the second adaptive component is generated based on the first fixed contribution for a previous frame, while in the second mode, the second adaptive component is generated based on a second fixed contribution for the previous frame. The second decoder operates in the second mode in response to a rate reduction request. A processing module determines the dimmed excitation parameters for generation of the second fixed contribution for the current frame, based on the target excitation and the second adaptive contribution.

36 Claims, 8 Drawing Sheets

| Field | Packet Type | | |
|---|---|---|---|
| | Full-Rate | Half-Rate 1/2 | Eighth-Rate 1/8 |
| Spectral Transition | 1 | | |
| Line Spectrum Information | 28 | 22 | 8 |
| Pitch Delay | 7 | 7 | |
| Delta Delay | 5 | | |
| ACB Gain | 9 | 9 | |
| FCB Shape | 105 | 30 | |
| FCB Gain | 15 | 12 | |
| Frame Energy | | | 8 |
| (reserved) | 1 | | |
| Total Primary Traffic Bits | 171 | 80 | 16 |

FIG. 2

| Field | Packet Type | |
|---|---|---|
| | Full-Rate | Half-Rate 1/2 |
| Spectral Transition | 1 | Ignored |
| Line Spectrum Information | 28 | 22 |
| Pitch Delay | 7 | 7 |
| Delta Delay | 5 | Ignored |
| ACB Gain | 9 | 9 |
| FCB Shape | 105 | 30 |
| FCB Gain | 15 | 12 |
| Frame Energy | | |
| (reserved) | 1 | Ignored |
| Total Primary Traffic Bits | 171 | 80 |

FIG. 4

| Field | Packet Type | |
|---|---|---|
| | Full-Rate | Half-Rate 1/2 |
| Spectral Transition | 1 | Ignored |
| Line Spectrum Information | 28 | 22 |
| Pitch Delay | 7 | 7 (Identical) |
| Delta Delay | 5 | Ignored |
| ACB Gain | 9 | 9 (Identical) |
| FCB Shape | 105 | 30 |
| FCB Gain | 15 | 12 |
| Frame Energy | | |
| (reserved) | 1 | Ignored |
| Total Primary Traffic Bits | 171 | 80 |

FIG. 5A

| LSP Parameters | Number of LSP Parameters | Codebook Number | Codebook Size | Number of Bits Allocated |
|---|---|---|---|---|
| Full-Rate | | | | |
| $\Omega_1, \Omega_2$ | 2 | 1 | 64 | 6 |
| $\Omega_3, \Omega_4$ | 2 | 2 | 64 | 6 |
| $\Omega_5, \Omega_6, \Omega_7$ | 3 | 3 | 512 | 9 |
| $\Omega_8, \Omega_9, \Omega_{10}$ | 3 | 4 | 128 | 7 |
| Half-Rate | | | | |
| $\Omega_1, \Omega_2, \Omega_3$ | 3 | 5 | 128 | 7 |
| $\Omega_4, \Omega_5, \Omega_6$ | 3 | 6 | 128 | 7 |
| $\Omega_7, \Omega_8, \Omega_9, \Omega_{10}$ | 4 | 7 | 256 | 8 |

FIG. 5B

| Field | Packet Type | |
|---|---|---|
| | Full-Rate | Half-Rate 1/2 |
| Spectral Transition | 1 | |
| Line Spectrum Information | 28 | 22 |
| Pitch Delay | 7 | 7 (Identical) ← |
| Delta Delay | 5 | |
| ACB Gain | 9 | 9 (Identical) ← |
| FCB Shape | 105 | 30 ← |
| FCB Gain | 15 | 12 ← |
| Frame Energy | | |
| (reserved) | 1 | |
| Total Primary Traffic Bits | 171 | 80 |

FIG. 6A

METHOD AND APPARATUS FOR RATE REDUCTION OF CODED VOICE TRAFFIC

FIELD OF THE INVENTION

The present invention relates generally to speech coding and, in particular, to a method and apparatus for rate reduction of coded voice traffic traveling in a packet network.

BACKGROUND

In a mobile telephony system, ancillary information (e.g., signaling information, overhead, enhanced forward error correction channel coding) is needed to adjust, control, and coordinate the system's configuration and operation. In some instances, the need to communicate ancillary information to a far-end mobile may arise while the far-end mobile is in use. When this occurs, the mobile and the base station combine the ancillary information with voice traffic. If the bandwidth on the wireless link leading to the far-end mobile is fully occupied, the coding rate of the voice traffic will need to be reduced to make room for the ancillary information.

In another scenario, congestion in a packet network may require a rate reduction to be effected, in order to allow a call to continue to be at least minimally supported between two end points so that the call is not dropped. Such requirement for a rate reduction may occur at random times, irrespective of the coding rate of voice traffic traveling in the packet network.

To achieve rate reduction in a network that carries packets of coded voice traffic, several methods have been proposed. One rather rudimentary way of effecting rate reduction of coded voice traffic traveling in a packet network is to drop packets. In this mode of operation, a packet (or plural packets) of coded voice traffic is/are suppressed (i.e., not transmitted, or "blanked") in order to liberate bandwidth, either downstream in the packet network or on the wireless link with the far-end mobile. However, the consequence of such drastic deletion of packets is a degradation of the recovered speech that could lead to a severe loss of intelligibility.

A slightly more sophisticated multiplexing technique for rate reduction of coded voice traffic traveling in a packet network consists of decoding (i.e., synthesizing) a received packet of coded voice traffic that was coded at an original (i.e., higher) rate. The fully synthesized speech signal is then re-coded at a lower rate, thereby preserving certain characteristics of the original speech, while freeing up bandwidth to insert the ancillary information or to alleviate network congestion. The operation of decoding the coded voice traffic into recovered speech and re-coding the recovered speech at a different (i.e., lower) rate is known as transcoding (or "tandem operation"), which has the disadvantage of requiring the processing and memory resources for a full codec just to provide rate reduction functionality. In the case of most codecs, the additional resources/cost associated with providing rate reduction functionality of the type described above are considered too high for mass implementation. In addition, transcoding exposes the speech to possible degradation as it is synthesized and then re-coded.

Moreover, both of the above techniques can lead to severe degradations in voice quality during prolonged periods of a required rate reduction, such as may occur when, for example, two air interfaces need to run at different packet rates for a mobile-to-mobile call. In such cases, the coded voice traffic emanating from the near-end mobile may need to be reduced by the network before being transmitted to the far-end mobile until the radio condition improves. Such a situation may last for several seconds or even minutes, which tends to have significant deleterious effects on intelligibility when conventional rate reduction methods are employed.

Therefore, a need exists in the industry to provide an improved mechanism for reducing the coding rate of coded voice traffic traveling in a packet network without significantly affecting voice quality.

SUMMARY OF THE INVENTION

A first broad aspect of the present invention seeks to provide a conversion entity for converting higher-rate speech parameters for a current frame into lower-rate speech parameters for the current frame. The conversion entity comprises a first decoder configured to produce a respective target excitation signal for each of a series of frames including the current frame and a previous frame, the target excitation signal for a given frame being based on a respective first fixed contribution for the given frame and a respective first adaptive contribution for the given frame. The conversion entity further comprises a second decoder configured to produce a second adaptive contribution for the current frame and further configured to selectably operate in a first mode or a second mode. In the first mode, the second adaptive contribution for the current frame are generated based on the first fixed contribution for the previous frame. In the second mode, the second adaptive contribution for the current frame are generated based on a second fixed contribution for the previous frame. The second decoder is configured to operate in the second mode in response to a rate reduction request for the current frame. The conversion entity further comprises a processing module configured to determine dimmed excitation parameters for the current frame, which are included in the lower-rate speech parameters for the current frame. The dimmed excitation parameters for the current frame are generated based on the target excitation signal for the current frame and the second adaptive contribution for the current frame, the dimmed excitation parameters for the current frame being used to generate a second fixed contribution for the current frame. The dimmed excitation parameters for the current frame.

A second broad aspect of the present invention seeks to provide an apparatus comprising the aforesaid conversion entity and a packetizing entity configured to insert the lower-rate speech parameters for the current frame into an output packet.

A third broad aspect of the present invention seeks to provide a conversion entity for converting higher-rate speech parameters for a current frame into lower-rate speech parameters for the current frame. The conversion entity comprises first means, for producing a respective target excitation signal for each of a series of frames including the current frame and a previous frame, the target excitation signal for a given frame being based on a respective first fixed contribution for the current frame and a respective first adaptive contribution for the given frame. The conversion entity further comprises second means, for producing a second adaptive contribution for the current frame and further configured to selectably operate in a first mode or a second mode. In the first mode, the second adaptive contribution for the current frame is generated based on the first fixed contribution for the previous frame. In the second mode, the second adaptive contribution for the first frame is generated based on a second fixed contribution for the previous frame. The second means is configured to operate in the second mode in response to a rate reduction request for the current frame. The conversion entity also comprises third means, for determining dimmed excitation parameters for the current frame, which are included in the lower-rate speech parameters for the current frame. The dimmed excitation parameters for the current frame are generated based on the target excitation signal for the current frame and the second adaptive contribution for the current frame, the dimmed excitation parameters for the current frame being used to generate a second fixed contribution for the current frame.

A fourth broad aspect of the present invention seeks to provide a computer readable medium comprising computer-readable program code executable by a computing apparatus to cause the computing apparatus to execute a method of converting higher-rate speech parameters for a current frame into lower-rate speech parameters for the current frame. The computer-readable program code comprises first computer-readable program code for causing the computing apparatus to produce a respective target excitation signal for each of a series of frames including the current frame and a previous frame, the target excitation signal for a given frame being based on a respective first fixed contribution for the given frame and a respective first adaptive contribution for the given frame. The computer-readable program code also comprises second computer-readable program code for causing the computing apparatus to produce a second adaptive contribution for the current frame in one of a first and a second mode, where operation in said second mode is in response to a rate reduction request for the current frame. In the first mode, the second adaptive contribution for the current frame is generated based on the first fixed contribution for the previous frame. In the second mode, the second adaptive contribution for the current frame is generated based on a second fixed contribution for the previous frame. The computer-readable program code further comprises third computer-readable program code for causing the computing apparatus to determine dimmed excitation parameters for the current frame, which are included in the lower-rate speech parameters for the current frame. The dimmed excitation parameters for the current frame are generated based on the target excitation signal for the current frame and the second adaptive contribution for the current frame, the dimmed excitation parameters for the current frame being used to generate a second fixed contribution for the current frame.

A fifth broad aspect of the present invention seeks to provide a method of converting a set of N encoded higher-rate parameters related to formant frequency content into a set of N encoded lower-rate parameters related to formant frequency content. The method comprises identifying a plurality of subsets of encoded higher-rate parameters in the set of N encoded higher-rate parameters. For each particular one of a plurality of subsets of encoded lower-rate parameters in the set of N encoded lower-rate parameters, the method comprises deriving the encoded lower-rate parameters in said particular subset of encoded lower-rate parameters from the encoded higher-rate parameters in one or more corresponding ones of the subsets of encoded higher-rate parameter, wherein the N encoded lower-rate parameters are capable of being represented using fewer bits than the N encoded higher-rate parameters.

A sixth broad aspect of the present invention seeks to provide a computer readable medium comprising computer-readable program code executable by a computing apparatus to cause the computing apparatus to execute a method of converting a set of N encoded higher-rate parameters related to formant frequency content into a set of N encoded lower-rate parameters related to formant frequency content. The computer-readable program code comprises first computer-readable program code for causing the computing apparatus to identify a plurality of subsets of encoded higher-rate parameters in the set of N encoded higher-rate parameters; second computer-readable program code for causing the computing apparatus to derive, for each particular one of a plurality of subsets of encoded lower-rate parameters in the set of N encoded lower-rate parameters, the encoded lower-rate parameters in said particular subset of encoded lower-rate parameters from the encoded higher-rate parameters in one or more corresponding ones of the subsets of encoded higher-rate parameters; wherein the N encoded lower-rate parameters are capable of being represented using fewer bits than the N encoded higher-rate parameters.

A seventh broad aspect of the present invention seeks to provide a method of processing an original parametric representation of a speech frame, the original parametric representation of the speech frame comprising higher-rate parameters related to formant frequency content and higher-rate parameters related to an excitation signal. The method comprises receiving a rate reduction request for the speech frame; producing lower-rate parameters related to formant frequency content by processing said higher-rate parameters related to formant frequency content without synthesizing formant frequency content from said higher-rate parameters related to formant frequency content; producing lower-rate parameters related to an excitation signal by processing said higher-rate parameters related to an excitation signal without synthesizing formant frequency content from said higher-rate parameters related to formant frequency content; outputting a dimmed parametric representation of the speech frame comprising said lower-rate parameters related to formant frequency content and said lower-rate parameters related to an excitation signal; the combination of said lower-rate parameters related to formant frequency content and said lower-rate parameters related to an excitation signal occupying fewer bits than the combination of said higher-rate parameters related to formant frequency content and said higher-rate parameters related to an excitation signal.

An eighth broad aspect of the present invention seeks to provide a conversion entity for processing an original parametric representation of a speech frame, the original parametric representation of the speech frame comprising higher-rate parameters related to formant frequency content and higher-rate parameters related to an excitation signal, the conversion entity comprising: means for receiving a rate reduction request for the speech frame; means for producing lower-rate parameters related to formant frequency content by processing said higher-rate parameters related to formant frequency content without synthesizing formant frequency content from said higher-rate parameters related to formant frequency content; means for producing lower-rate parameters related to an excitation signal by processing said higher-rate parameters related to an excitation signal without synthesizing formant frequency content from said higher-rate parameters related to formant frequency content; means for outputting a dimmed parametric representation of the speech frame comprising said lower-rate parameters related to formant frequency content and said lower-rate parameters related to an excitation signal; wherein the combination of said lower-rate parameters related to formant frequency content and said lower-rate parameters related to an excitation signal occupies fewer bits than the combination of said higher-rate parameters related to formant frequency content and said higher-rate parameters related to an excitation signal.

A ninth broad aspect of the present invention seeks to provide a computer readable medium comprising computer-readable program code executable by a computing apparatus to cause the computing apparatus to execute a method of processing an original parametric representation of a speech frame, the original parametric representation of the speech frame comprising higher-rate parameters related to formant frequency content and higher-rate parameters related to an excitation signal. The computer-readable program code comprises first computer-readable program code for causing the computing apparatus to receive a rate reduction request for the speech frame; second computer-readable program code for causing the computing apparatus to produce lower-rate parameters related to formant frequency content by processing said higher-rate parameters related to formant frequency content without synthesizing formant frequency content from said higher-rate parameters related to formant frequency content; third computer-readable program code for causing the computing apparatus to produce lower-rate parameters related to an excitation signal by processing said higher-rate parameters related to an excitation signal without synthesizing formant frequency content from said higher-rate parameters related to formant frequency content; fourth computer-readable program code for causing the computing apparatus to output a dimmed parametric representation of the speech frame comprising said lower-rate parameters related to formant frequency content and said lower-rate parameters related to an excitation signal; wherein the combination of said lower-rate parameters related to formant frequency content and said lower-rate parameters related to an excitation signal occupies fewer bits than the combination of said higher-rate parameters related to formant frequency content and said higher-rate parameters related to an excitation signal.

A tenth broad aspect of the present invention seeks to provide a method of converting higher-rate speech parameters for a current frame into lower-rate speech parameters for the current frame. The method comprises producing a respective target excitation signal for each of a series of frames including the current frame and a previous frame, the target excitation signal for a given frame being based on a respective first fixed contribution for the given frame and a respective first adaptive contribution for the given frame. The method also comprises producing a second adaptive contribution for the current frame in one of a first and a second mode where in the first mode, the second adaptive contribution for the current frame is generated based on the first fixed contribution for the previous frame, and where in the second mode, the second adaptive contribution for the current frame is generated based on a second fixed contribution for the previous frame, and where operation in said second mode is in response to a rate reduction request for the current frame. The method also comprises determining dimmed excitation parameters for the current frame, the dimmed excitation parameters for the current frame being included in the lower-rate speech parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

In the accompanying drawings:

FIG. 2 is a table showing bit allocation to various parameters in the example original parametric representation of the speech frame;

FIG. 4 shows certain parameters in the example original parametric representation that are not present in the example dimmed parametric representation;

FIG. 5A indicates parameters related to formant frequency content, which are present in the example original parametric representation and which are also present in the example dimmed parametric representation, but to which fewer bits are allocated;

FIG. 5B illustrates how the conversion entity effects decomposition of the parameters related to formant frequency content into individual spectrum information;

FIG. 6A shows parameters related to an excitation signal, which are present in the original parametric representation and which are also present in the dimmed parametric representation, but to which fewer overall bits are allocated;

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

Figure 1:
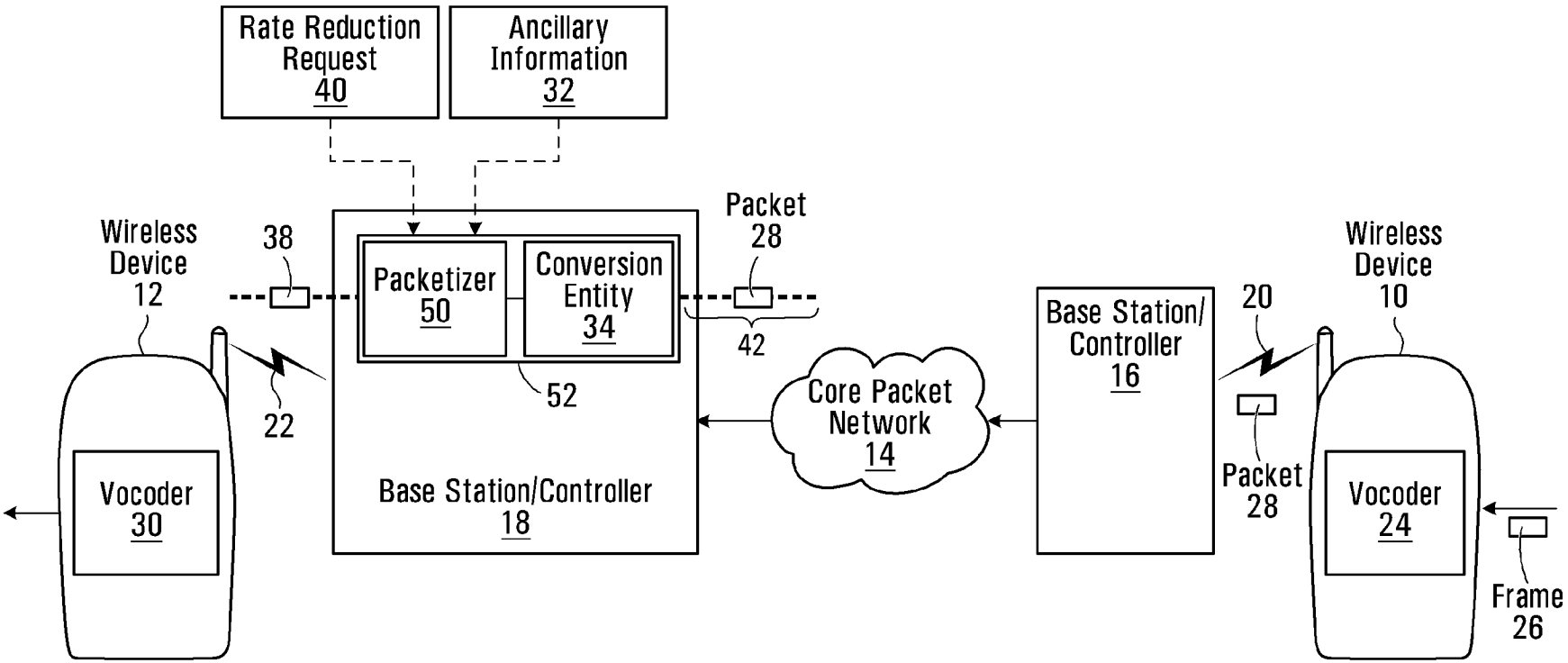
FIG. 1 is a block diagram of a mobile telephony architecture in accordance with a specific non-limiting embodiment of the present invention, comprising a conversion entity for converting an example original parametric representation of a speech frame, contained in a received packet, into an example dimmed parametric representation, which is placed into an output packet.

With reference to FIG. 1, there is shown a mobile telephony architecture in which a wireless device 10 is in communication with a wireless device 12 over a core packet network 14. Only one direction of communication (from wireless device 10 to wireless device 12) is shown for simplicity, but it should be understood that communication is typically expected to be bidirectional. For the sake of clarity, wireless device 10 will be referred to as a near-end wireless device and wireless device 12 will be referred to as a far-end wireless device.

At the edges of the core packet network 14 are two base stations/controllers 16, 18. Base station/controller 16 acts as a gateway between the near-end wireless device 10 and the core packet network 14, while base station/controller 18 acts as a gateway between the core packet network 14 and the far-end wireless device 12. Thus, in order for a packet sent by the near-end wireless device 10 to reach the far-end wireless device 12, the near-end wireless device 10 transmits the packet to base station/controller 16 over a wireless link 20, which forwards the packet over the core packet network 14 to base station/controller 18, which then forwards the packet to the far-end wireless device 12 over a second wireless link 22.

Those skilled in the art will appreciate that the physical configuration, and hence the name used to refer to, the base stations/controllers 16 and 18 is not critical to the present invention. Thus, one may use the term gateway, router, switch, controller, network entity, etc. without departing from the spirit of the present invention.

The near-end wireless device 10 comprises a vocoder (or speech codec) 24 that encodes consecutive frames of speech 26 (e.g., twenty (20) milliseconds in duration) into respective packets of coded voice traffic 28. A packet of coded voice traffic 28 contains a parametric (rather than sampled) representation of the frame of speech 26 from which it was derived. The parametric representation is optimized to contain certain critical parameters that allow a far-end vocoder (such as a vocoder 30 in the far-end wireless device 12) to reproduce the frame of speech 26 with sufficient intelligibility. The main advantage to using a parametric representation is the reduced amount of bandwidth that it requires, when compared to sampled speech. Thus, the use of vocoders (such as vocoders 24, 30) is popular in mobile environments. However, it should be understood that the present invention is not limited to mobile environments.

Different vocoders seek to encode different parameters with varying degrees of accuracy. In fact, some vocoders (such as the vocoder 24) even allow the encoding scheme to be changed from one frame of speech to the next, depending on a measured characteristic of the frame of speech in question. One simple approach is to determine whether the frame of speech (such as the frame of speech 26) is voiced or unvoiced or in transition, i.e., contains strong formant frequency content or does not contain strong formant frequency content or falls somewhere in between. If the frame of speech 26 is voiced or in certain transitions (e.g., silence-to-speech), then more parameters (at higher degrees of accuracy) are required, but if the frame of speech 26 is unvoiced or is in certain other transitions (e.g., speech-to-silence), then fewer parameters (at lower degrees of accuracy) are required to obtain comparable intelligibility of the speech when it is recovered at the far-end vocoder, in this case vocoder 30. Thus, it is possible to utilize a vocoder capable of operating at multiple different rates, suitable non-limiting examples of which include EVRC-A (Enhanced Variable Rate Codec Revision A), QCELP 13K (TIA-733), SMV (Selectable Mode Vocoder), EVRC-B, AMR (Adaptive Multi Rate), ITU-T G.729, ITU-T G723.1, among other possible vocoders. While EVRC-A will be used as an example throughout the specification, those skilled in the art will appreciate that the present invention is equally applicable to the other aforementioned vocoders and still others that may be known to those of skill in the art or that are being (or will be) developed for future use.

Considering therefore the specific non-limiting example of EVRC-A, there are actually three modes of operation, namely full-rate, half-rate and eighth-rate. For more information regarding the EVRC-A vocoder and the decision to enter a particular mode, the reader is directed to http://www.3gpp2.com/Public_html/specs/C.S0014-A_v1.0_040426.pdf, hereby incorporated by reference herein. FIG. 2 shows in the left-hand column and in summary form, the parameters derivable for each frame of speech 26 and, in the adjacent column, the number of bits allocated to each parameter when the vocoder 24 operates in full-rate mode. It will be observed that the spectral transition parameter is allocated one (1) bit, the line spectrum information is allocated twenty-eight (28) bits, the pitch delay is allocated seven (7) bits, the delta delay is allocated five (5) bits, the adaptive codebook (ACB) gain is allocated nine (9) bits, the fixed codebook (FCB) shape is allocated one hundred and five (105) bits, the fixed codebook (FCB) gain is allocated fifteen (15) bits, the frame energy is not allocated any bits, and one (1) bit is reserved, for a total of one hundred and seventy-one (171) "primary traffic" bits.

In the next adjacent column, FIG. 2 shows the number of bits allocated to each parameter when the vocoder 24 operates in half-rate mode. It will be observed that the spectral transition parameter is not allocated any bits, the line spectrum information is allocated twenty-two (22) bits, the pitch delay is allocated seven (7) bits, the delta delay is not allocated any bits, the adaptive codebook (ACB) gain is allocated nine (9) bits, the fixed codebook (FCB) shape is allocated thirty (30) bits, the fixed codebook (FCB) gain is allocated twelve (12) bits, the frame energy is not allocated any bits, and there are no reserved bits, for a total of eighty (80) primary traffic bits.

In the right-most column, FIG. 2 shows the number of bits allocated to each parameter when the vocoder 24 operates in eighth-rate mode. It will be observed that the only parameters to which bits are allocated include the line spectrum information and the frame energy, each with eight (8) bits, for a total of sixteen (16) primary traffic bits.

In the mobile telephony architecture of FIG. 1, ancillary information 32 (including but not limited to signaling information, overhead, enhanced forward error correction channel coding) may be needed to adjust, control, and coordinate the configuration and operation of the various elements of the architecture, such as the wireless devices 10, 12 and the base stations/controllers 16, 18. The ancillary information 32 may also include communication data such as a text message, instant message and/or electronic mail message. When the far-end wireless device 12 is involved in a call that utilizes the full available bandwidth on the wireless link 22 between base station/controller 18 and the far-end wireless device 12 (i.e., during frames of speech generated requiring the use of a full-rate parametric representation), then a rate reduction approach is needed to allow the ancillary information 32 to reach the far-end wireless device 12 during this call. Similarly, when there is congestion in the core packet network 14, which reduces the bandwidth available to support a call with the far-end wireless device 12, a rate reduction approach is needed to maintain the call alive.

Accordingly, in this specific non-limiting example, and in accordance with a non-limiting embodiment of the present invention, base station/controller 18 comprises a processing entity 52 that comprises a conversion entity 34 and a packetizing entity 50. The conversion entity 34 is configured to perform a "dimming" operation, i.e., conversion of an original parametric representation of a frame of speech contained in a received packet 28 into a dimmed parametric representation of that frame of speech. The packetizing entity 50 is configured to place the dimmed parametric representation into an output packet 38. The packetizing entity 50 may further place the ancillary information 32 into the output packet 38.

The conversion entity 34 that executes the dimming operation is responsive to a "rate reduction request" 40, which indicates that a reduction in the speech coding rate of the received packet 28 is desired. The rate reduction request 40, which can be embodied in a non-limiting example as a dim-and-burst request, may be generated by base station/controller 18 or another network entity, as appropriate, for a number of reasons that will be apparent to one of skill in the art. The rate reduction request 40 may affect one isolated received packet 28, or a series 42 of consecutive received packets.

Although in FIG. 1 it is base station/controller 18 that is shown as comprising the conversion entity 34 for executing the dimming operation, it should be appreciated that the dimming operation may be executed by a conversion entity implemented in base station/controller 16 and/or any other network entity between the near-end wireless device 10 and the far-end wireless device 12. The need for a conversion entity 34 within the core packet network 14 may arise, for example, to alleviate network congestion.

Figure 3:
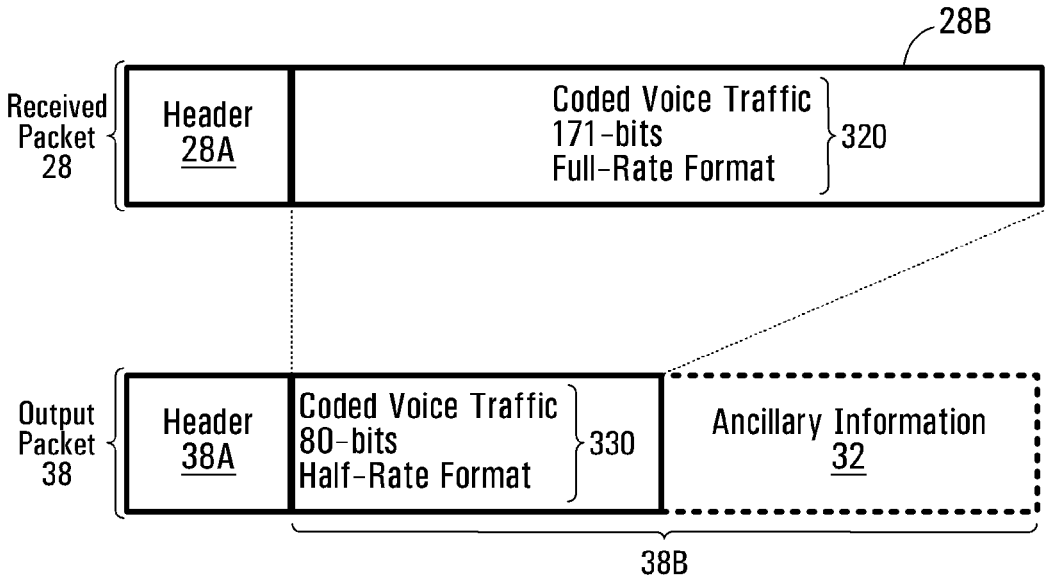
FIG. 3 depicts the reduced number of bits in the example dimmed parametric representation of the speech frame, in addition to the insertion of ancillary information into the received packet.

FIG. 3 illustrates the functionality of the conversion entity 34 in terms of an example received packet 28 and a corresponding example output packet 38. Those skilled in the art will appreciate that each of the packets 28, 38 has a respective header 28A, 38A and a respective payload 28B, 38B. As can be seen, the payload 28B of the received packet 28 comprises an original parametric representation 320 of a frame of speech which is, in this specific case, a full-rate representation as produced by the vocoder 24 in the near-end wireless device 10. Thus, there are one hundred and seventy-one (171) traffic bits in the original parametric representation 320. The 171 traffic bits may be preceded by an additional mode bit (not shown), which indicates that the packet 28 comprises an original parametric representation (rather than a dimmed parametric representation) of a frame of speech.

The dimming operation performed by the conversion entity 34 consists of responding to the rate reduction request 40 by converting the original parametric representation 320 into a dimmed parametric representation 330 that has fewer bits. In this case, the dimmed parametric representation 330 has the same number of bits as a half-rate parametric representation, namely eighty (80) bits. These eighty (80) bits are placed into the output packet 38, leaving ninety-one (91) additional bits, which would have been consumed if the received packet 28 had been simply forwarded in its original form by base station/controller 18. However, the dimming operation has now liberated these bits, making them available to transport the ancillary information 32, or simply to not be transported, thus reducing the bandwidth on the wireless link 22 between the base station/controller 18 and the far-end wireless device 12. In a non-limiting example embodiment, the aforesaid mode bit (not shown) may be used to indicate that the packet 38 contains a dimmed parametric representation (rather than an original parametric representation) of a frame of speech.

One specific non-limiting example of the manner in which the conversion entity 34 converts the original parametric representation 320 into the dimmed parametric representation 330 will now be described.

Ignored Parameters

Certain parameters in the original parametric representation 320 are ignored and thus do not appear in the dimmed parametric representation 330. As shown in FIG. 4, this is the case with the one (1) bit of the spectral transition parameter, the five (5) bits of the delta delay and the reserved bit, none of which appear in the dimmed parametric representation 330.

Parameters Related to Formant Frequency Content

The parameters related to formant frequency content comprise the line spectrum information which, with reference to FIG. 5A, occupy twenty-eight (28) bits in the original parametric representation 320 but occupy only twenty-two (22) bits in the dimmed parametric representation 330. The manner in which the individual bits are allocated to the line spectrum information in each parametric representation is now described with reference to FIG. 5B. In the present example, the line spectrum information consists of line spectrum pairs, but this is not to be considered limiting.

Specifically, the parameters related to formant frequency content comprise ten (10) component line spectrum pairs, denoted Ω1, Ω2, . . . Ω10. Of course, different vocoders may utilize different numbers of line spectrum pairs, and thus the numbers used herein, which are merely a specific illustration, are not to be considered limiting. With specific reference to FIG. 5B, therefore, it is noticed that the ten (10) line spectrum pairs in the original parametric representation 320 are grouped into four sets of line spectrum pairs, namely Ω1 and Ω2 in the first set, Ω3 and Ω4 in the second set, Ω5, Ω6 and Ω7 in the third set and Ω8, Ω9 and Ω10 in the fourth set. Each set of line spectrum pairs is separately encoded using a separate "codebook", namely codebook 1 for the first set, and so on. A codebook can be defined as an indexable database that stores certain features associated with each entry.

The contents of each of the codebooks is optimized in order to result in efficient joint coding of the line spectrum pairs in the associated set. Thus, the codebooks vary in size. In the case of codebook 1, which is used to jointly code line spectrum pairs Ω1 and Ω2, sixty-four (64) entries (i.e., six bits) is considered to be sufficient. Thus, each six-bit combination is used to index a different entry in codebook 1, which contains 64 possible combinations of features for line spectrum pairs Ω1 and Ω2. This is sometimes referred to as split vector quantization Similarly, codebook 2, which is used to jointly code line spectrum pairs Ω3 and Ω4, also comprises sixty-four entries (i.e., six bits). For its part, codebook 3, which is used to jointly code line spectrum pairs Ω5, Ω6 and Ω7, has five hundred and twelve (512) entries, which corresponds to an index of nine bits. Finally, codebook 4, which is used to jointly code line spectrum pairs Ω8, Ω9 and Ω10, has one hundred and twenty-eight (128) entries, which corresponds to an index of seven bits.

Continuing with reference to FIG. 5B, the ten (10) line spectrum pairs in the dimmed parametric representation 320 are broken down into three sets of line spectrum pairs, namely Ω1, Ω2 and Ω3 in the first set, Ω4, Ω5 and Ω6 in the second set, and Ω7, Ω8, Ω9 and Ω10 in the third set. Each set of line spectrum pairs is separately encoded using a separate codebook, namely codebook 5 for the first set, codebook 6 for the second set and codebook 7 for the third set. The contents of each of the codebooks is optimized in order to result in efficient joint coding of the line spectrum pairs in the associated set. Thus, as with codebooks 1, 2, 3 and 4, codebooks 5, 6 and 7 also vary in size, yet may bear little if any resemblance to codebooks 1, 2, 3 and 4. In the case of codebook 5, which is used to jointly code line spectrum pairs Ω1, Ω2 and Ω3, one hundred and twenty-eight (128) entries (i.e., seven bits) is considered to be sufficient. For its part, codebook 6, which is used to jointly code line spectrum pairs Ω4, Ω5 and Ω6, also comprises one hundred and twenty-eight (128) entries (i.e., seven bits). Finally, codebook 7, which is used to jointly code line spectrum pairs Ω7, Ω8, Ω9 and Ω10, has two hundred and fifty-six entries, which corresponds to an index of eight bits. It is noted that codebooks 5, 6 and 7 should be the ones used by the vocoder 30 to decode the parameters related to formant frequency content that would have been encoded in a half-rate representation produced by the vocoder 24 in the near-end wireless device 10.

Figure 5C:
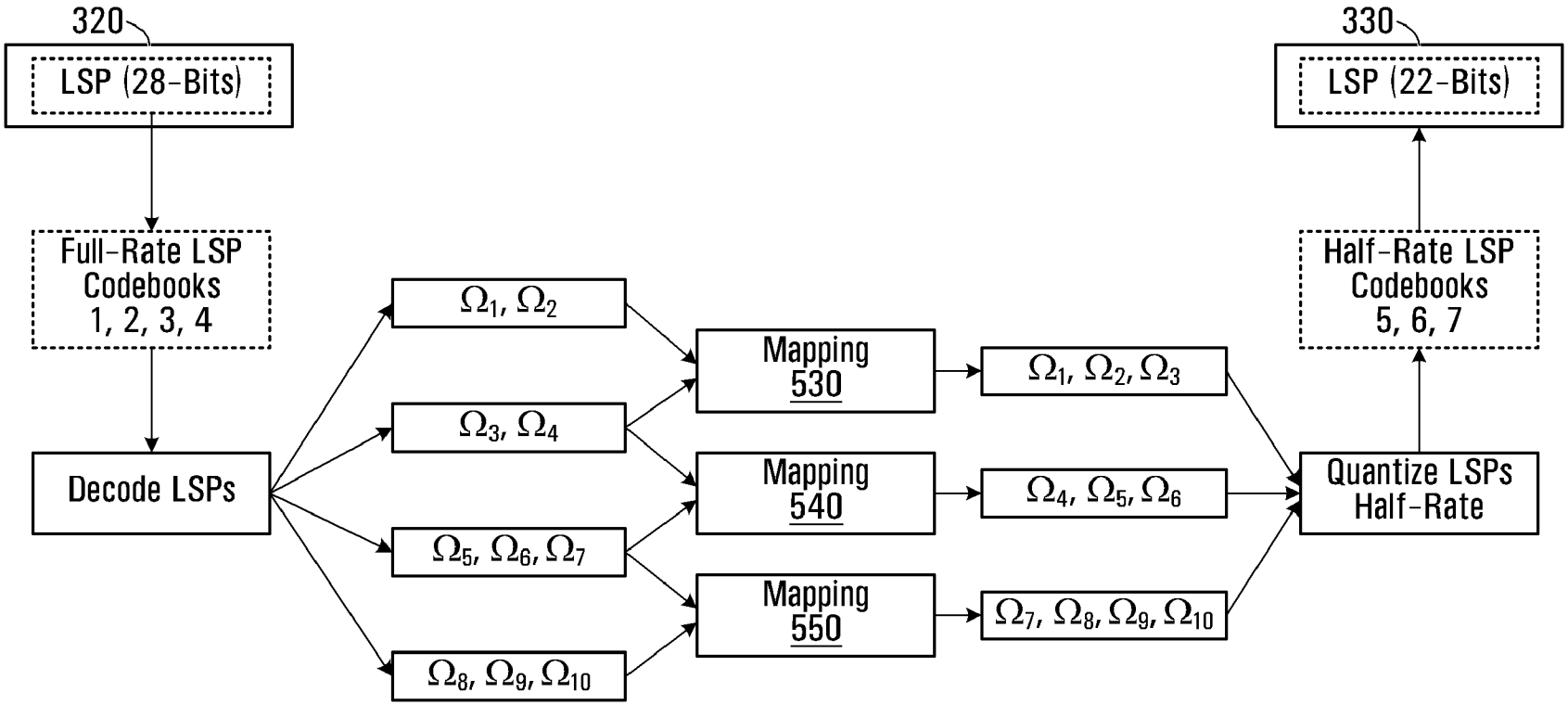
FIG. 5C shows sets of spectrum information in the example original parametric representation used to create sets of spectrum information in the example dimmed parametric representation.

In order to reduce the number of bits, the conversion entity 34 comprises suitable circuitry, software and/or control logic for implementing an input-output transformation that is created on the basis of the following technique, described with reference to FIG. 5C. Specifically, the first set, and part of the second set, of the line spectrum pairs in the original parametric representation 320 are mapped to the first set of line spectrum pairs in the dimmed parametric representation 330. A first mapping 530 may be used for this purpose. The result of the first mapping 530, which essentially ignores the contribution of the line spectrum pair Ω4, results in selection of a seven-bit index that encodes the line spectrum pairs Ω1, Ω2 and Ω3 in the dimmed parametric representation 330. In addition, part of the second set, and part of the third set, of the line spectrum pairs in the original parametric representation 320 are mapped to the second set of line spectrum pairs in the dimmed parametric representation 330. A second mapping 540 may be used for this purpose. The result of the second mapping 540, which essentially ignores the contribution of the line spectrum pairs Ω3 and Ω7, results in selection of a seven-bit index that encodes the line spectrum pairs Ω4, Ω5 and Ω6 in the dimmed parametric representation 330. Finally, part of the third set, together with the fourth set, of the line spectrum pairs in the original parametric representation 320 are mapped to the third and final set of line spectrum pairs in the dimmed parametric representation 330. A third mapping 550 may be used for this purpose. The result of the third mapping 550, which essentially ignores the contribution of the line spectrum pairs Ω5 and Ω6, results in selection of an eight-bit index that encodes the line spectrum pairs Ω7, Ω8, Ω9 and Ω10 in the dimmed parametric representation 330.

The contents of the mappings 530, 540 and 550 can be optimized in an offline fashion to ensure, for example, that stability considerations are met for all possible combinations of line spectrum pairs in the original parametric representation 320. An example of a stability consideration, not to be considered limiting, is to ensure that the line spectrum pairs are in ascending order and that there is a minimum distance between two consecutive line spectrum pairs. Alternatively, as the processing involved in performing a stability check is small, such can be performed in real time for the specific collection of line spectrum pairs Ω1, . . . , Ω10.

It is noted that the input-output transformation does not require speech (or even formant frequency content thereof) to be synthesized from the line spectrum pairs in the original parametric representation 320. As such, the computational resources associated with speech synthesis are saved.

Of course, those skilled in the art will appreciate that the number of mappings 530, 540, 550 to be performed depends on the relationship between the groupings of line spectrum pairs in the original parametric representation 320 and in the dimmed parametric representation 330. Also, the number of line spectrum pairs itself is a design choice, and those skilled in the art will appreciate that there is no specific limit on the number of line spectrum pairs that are to be mapped from the original parametric representation 320 to the dimmed parametric representation 330. In some cases, a design choice may be made such that one or more line spectrum pairs in the original parametric representation 320 is/are ignored and therefore is/are not made to appear in the dimmed parametric representation 330.

Parameters Related to an Excitational Signal

Figure 6B:
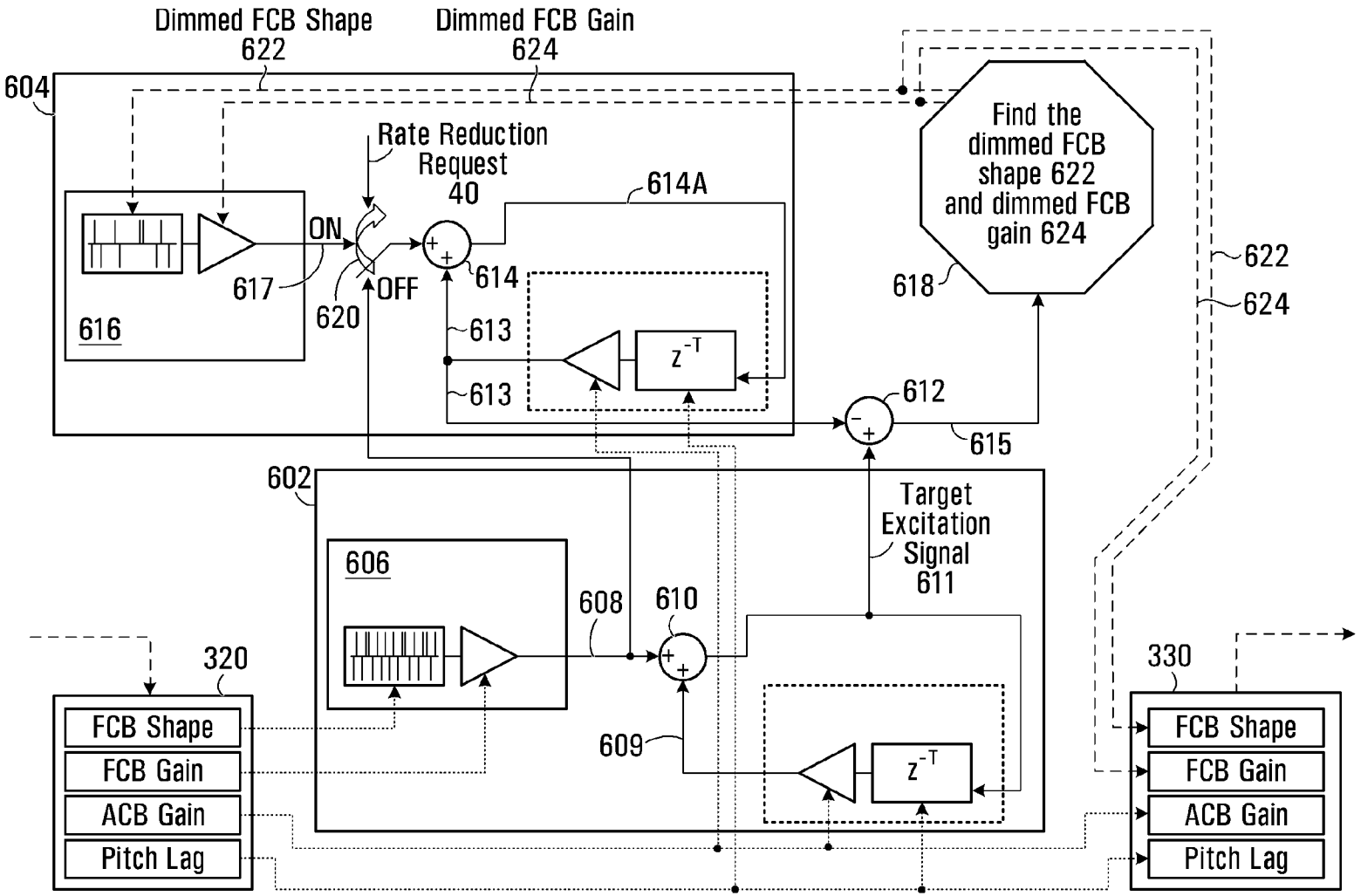
FIG. 6B is a block diagram illustrating the functionality of the conversion entity in converting the parameters related to an excitation signal from the example original parametric representation into the example dimmed parametric representation.

The parameters related to an excitation signal comprise the pitch delay, the ACB gain, the FCB shape and the FCB gain. They are also known as "excitation parameters". With reference to FIG. 6A, in a specific embodiment, not to be considered limiting, the seven (7) bits of the pitch delay and the nine (9) bits of the ACB gain are placed into the dimmed parametric representation 330 unchanged. On the other hand, the number of bits allocated to the FCB shape is reduced from one hundred and five (105) to thirty (30), while the number of bits allocated to the FCB gain is reduced from fifteen (15) to twelve (12). The manner in which the reduction in the number of bits is achieved by the conversion entity 34 will now be described with reference to FIG. 6B.

Specifically, the conversion entity 34 further comprises suitable circuitry, software and/or control logic for implementing a first decoder 602 and a second decoder 604.

The first decoder 602 comprises a fixed component signal generator 606 that operates on the FCB shape and the FCB gain in the original parametric representation 320 for the current frame to generate a fixed codebook contribution 608 for the current frame. Those skilled in the art will be acquainted with techniques for generating signals such as the fixed codebook contribution 608 and therefore a detailed description of such techniques is not required here. The fixed codebook contribution 608 for the current frame, produced by the fixed component signal generator 606, is then fed to an input of a two-input summation block 610. The other input of the summation block 610 is hereinafter referred to as a "full-rate adaptive codebook contribution" 609 for the current frame, which consists of a previously stored output of the summation block 610, delayed by the pitch delay (or "pitch lag") in the original parametric representation 320 for the current frame and amplified by the ACB gain in the original parametric representation 320 for the current frame. (Other operations, such as smoothing and filtering, may also be performed on the previously stored output of the summation block 610 in its transformation into the full-rate adaptive codebook contribution 609 for the current frame.)

The output of the summation block 610 is then recomputed and stored in memory for use with the next frame, and so on. The output of the summation block 610, which is referred to herein below as a "target excitation signal" 611 for the current frame, is therefore a combination of (i) the fixed codebook contribution 608 for the current frame and (ii) the full-rate adaptive codebook contribution 609 for the current frame, which is itself based on the target excitation signal 611 for the previous frame but influenced by the ACB gain and the pitch delay in the original parametric representation 320 for the current frame.

For its part, operation of the second decoder 604 is dependent upon whether there has been a rate reduction request 40.

Case 1: No Rate Reduction Request

If there has been no rate reduction request 40, then one will appreciate that there is no need for a dimmed parametric representation 330 and no use of the conversion entity 34. However, in preparation for an eventual rate reduction request 40, the conversion entity 34 nevertheless attempts to track the state of the far-end vocoder 30 at the far-end wireless device 12.

To this end, while there is no rate reduction request 40 for the received packet 28, the second decoder 604 operates in a first mode whereby the fixed codebook contribution 608 for the current frame, produced by the fixed component signal generator 606, is fed to a first input of a two-input summation block 614. The other input of the summation block 614 is hereinafter referred to as a "dimmed adaptive codebook contribution" 613 for the current frame, which consists of a previously stored output 614A of the summation block 614, delayed by the pitch delay (or "pitch lag") in the original parametric representation 320 for the current frame and amplified by the ACB gain in the original parametric representation 320 for the current frame. (Other operations, such as smoothing and filtering, may also be performed on the previously stored output 614A of the summation block 614 in its transformation into the dimmed adaptive codebook contribution 613 for the current frame.) The output 614A of the summation block 614 is then recomputed and stored in memory for use with the next frame, which can be associated—or not—with a rate reduction request.

Case 2: Rate Reduction Request Received

When a rate reduction request 40 is received by the conversion entity 34 for the received packet 28, the second decoder 604 enters into a second mode of operation.

In this second mode of operation, the first step is to generate a "dimmed FCB shape" 622 and a "dimmed FCB gain" 624 for the current frame, which are used as the FCB shape and the FCB gain in the dimmed parametric representation 330 for the current frame. The dimmed FCB shape 622 and the dimmed FCB gain 624 for the current frame are generated by a processing module, which comprises a vector quantizer 618 and a comparator 612. Specifically, the comparator 612 is fed by (i) the target excitation signal 611 for the current frame (received from the first decoder 602) and (ii) the dimmed adaptive codebook contribution 613 for the current frame (received from the second decoder 604). In a specific non-limiting embodiment, the output of the comparator 612 (hereinafter referred to as a "difference signal" 615) represents the difference between the target excitation signal 611 for the current frame and the dimmed adaptive codebook contribution 613 for the current frame.

Now, it is recalled that the target excitation signal 611 for the current frame is the sum of the fixed codebook contribution 608 for the current frame and the full-rate adaptive codebook contribution 609 for the current frame. It is also noted that up until receipt of the rate reduction request 40, the second decoder 604 had been operating in the first mode, which means that the full-rate adaptive codebook contribution 609 for the current frame will be the same as the dimmed adaptive codebook contribution 613 for the current frame, because the same coefficients (ACB gain and pitch delay) were used in the respective decoders 602, 604. Therefore, up until receipt of the rate reduction request 40, the difference signal 615 at the output of the comparator 612 will track the fixed codebook contribution 608.

Consider now that the dimmed FCB shape 622 and the dimmed FCB gain 624 for the current frame are used for driving a second fixed component signal generator 616 to produce an output 617. Consider also that a switching unit 620 (implementable in, e.g., hardware, software and/or control logic) is provided, which can selectively feed the first input of the summation block 614 with the output 617 rather than with the first component signal 608.

Under these conditions, it will be apparent that the difference signal 615 represents what one would like the signal at the output 617 of the second fixed component signal generator 616 to be, if one wanted the output 614A of the summation block 614 to resemble, as much as possible (according to some criterion, e.g., least squares), the target excitation signal 611 for the current frame, thus minimizing voice quality impairments. To this end, using the same codebook as the far-end vocoder 30 in the far-end wireless device 12, the vector quantizer 618 encodes the difference signal 615 into the aforesaid dimmed FCB shape 622 and the dimmed FCB gain 624. In accordance with a specific non-limiting embodiment of the present invention, the vector quantizer 618 is a half-rate vector quantizer 618 used for determining the dimmed FCB shape 622 and the dimmed FCB gain 624.

The output 617 of the second fixed component signal generator 616, which is based on the dimmed FCB shape 622 and the dimmed FCB gain 624, is then passed through the summation block 614, where it is added to the dimmed adaptive codebook contribution 613 for the current frame (computed as indicated above). The output 614A of the summation block 614 is then recomputed and stored in memory for use with the next frame, which can be associated—or not—with a rate reduction request.

In a non-limiting embodiment, the dimmed FCB shape 622 and the dimmed FCB gain 624 are restricted to values which can be encoded by the number of bits allocated to the respective parameters in the dimmed parametric representation 330. In this specific non-limiting example, the dimmed FCB shape 622 is a value which can be encoded by thirty (30) bits allocated thereto, while the dimmed FCB gain 624 is a value which can be encoded by twelve (12) bits allocated thereto.

It will be appreciated that the dimmed FCB shape 622 and the dimmed FCB gain 624 may depend on all four of: the FCB shape, the FCB gain, the pitch delay and the ACB gain in the original parametric representation 320.

It should further be appreciated that if a rate reduction request 40 is received for a second consecutive received packet in the series 42 of received packets, the second decoder 604 will continue to operate in the second mode, whereby the first input to the summation block 614 is provided by the output 617 of the second fixed component signal generator 616. If a rate reduction request 40 is not requested for a given received packet in the series 42 of received packets, then the switching unit 620 in the second decoder 604 reverts back to the first mode, whereby the first input of the summation block 614 is provided by the fixed codebook contribution 608 produced by the fixed signal component signal generator 606.

It will therefore be appreciated that using the system of FIG. 6B, and more specifically by keeping the second decoder 604 active even when there is no rate reduction request 40, it is possible to track a memory state of the far-end vocoder 30, which allows a more optimized selection of the dimmed FCB shape 622 and the dimmed FCB gain 624 when the rate reduction request 40 is eventually received. This leads to an improvement in the perceived quality of speech when a rate reduction is in progress. It will therefore be appreciated that creating a lower-rate parametric representation of a speech frame from a higher-rate parametric representation of the speech frame in accordance with embodiments of the present invention results in a perceived voice quality that is comparable to the case where there was no rate reduction. At the same time, the techniques described herein require less computational effort than transcoding (i.e., recovering the full-rate speech and re-coding at half-rate).

Further improvements in computational performance may be achieved by simplifying the design of the vector quantizer 618. For instance, the vector quantizer 618 may use a look-up table to determine the dimmed FCB gain 624, and may use empirical pulse decimation (i.e., removing half of the non-zero pulses) to determine the dimmed FCB shape 622. Additional improvements in perceived voice quality are also possible, at the expense of greater computational complexity. For example, one can choose to adaptively determine not only the dimmed FCB gain 624 and the dimmed FCB shape 622, but also the ACB gain and/or the pitch delay. The trade-off between computational complexity and voice quality is therefore an inherent constraint and can be skewed in one direction or the other, depending on the design choice.

It should be reiterated that EVRC-A was used merely as an example and that other vocoders will be characterized by other bit allocations and other parameters altogether. Persons skilled in the art will therefore appreciate that the techniques described above remain valid and may be used to design techniques for creating a lower-rate parametric representation of a speech frame from a higher-rate parametric representation of the speech frame in a computationally efficient manner, one which does not require entire speech samples to be recovered, and therefore does not require parameters related to formant frequency content (i.e., the line spectrum information) to be identified and re-coded. In this way, the present invention can be applied to other vocoders, such as QCELP 13K (TIA-733), SMV (Selectable Mode Vocoder), EVRC-B, AMR (Adaptive Multi Rate), ITU-T G.729 and ITU-T G723.1, to name a few specific non-limiting examples.

Those skilled in the art will also appreciate that although the description above has focused on the case where a full-rate parametric representation of a speech frame has been reduced to a half-rate parametric representation, the present invention is also applicable to other rate reduction scenarios, such as, but not limited to: full-rate to eighth-rate, half-rate to eighth-rate, and generally $(N/M)^{th}$ rate to $(n/m)^{th}$ rate (where N/M>n/m), provided the $(n/m)^{th}$ rate is still suitable for speech frames.

Those skilled in the art will further appreciate that in some embodiments, the functionality of the conversion entity 34 may be implemented as pre-programmed hardware or firmware elements (e.g., application specific integrated circuits (ASICs), electrically erasable programmable read-only memories (EEPROMs), etc.), or other related components. In other embodiments, the conversion entity 34 may be implemented as an arithmetic and logic unit (ALU) having access to a code memory (not shown) which stores program instructions for the operation of the ALU. The program instructions could be stored on a medium which is fixed, tangible and readable directly by the conversion entity 34, (e.g., removable diskette, CD-ROM, ROM, fixed disk, USB drive), or the program instructions could be stored remotely but transmittable to the conversion entity 34 via a modem or other interface device (e.g., a communications adapter) connected to a network over a transmission medium. The transmission medium may be either a tangible medium (e.g., optical or analog communications lines) or a medium implemented using wireless techniques (e.g., microwave, infrared or other transmission schemes).

While specific embodiments of the present invention have been described and illustrated, it will be apparent to those skilled in the art that numerous modifications and variations can be made without departing from the scope of the invention as defined in the appended claims.

The invention claimed is:

1. A conversion entity for converting higher-rate speech parameters for a current frame into lower-rate speech parameters for the current frame, the conversion entity comprising:

a first decoder configured to produce a respective target excitation signal for each of a series of frames including the current frame and a previous frame, the target excitation signal for a given frame being based on a respective first fixed contribution for the given frame and a respective first adaptive contribution for the given frame;

a second decoder configured to produce a second adaptive contribution for the current frame and further configured to selectably operate in a first mode or a second mode;

in the first mode, the second adaptive contribution for the current frame being generated based on the first fixed contribution for the previous frame;

in the second mode, the second adaptive contribution for the current frame being generated based on a second fixed contribution for the previous frame;

the second decoder being configured to operate in the second mode in response to a rate reduction request for the current frame;

a processing module configured to determine dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate speech parameters for the current frame.

2. The conversion entity defined in claim 1, wherein the higher-rate speech parameters for the current frame comprise a first subset of higher-rate parameters for the current frame, wherein the first subset of higher-rate parameters for the current frame is used to generate the first fixed contribution for the current frame.

3. The conversion entity defined in claim 2, wherein the higher-rate speech parameters for the current frame further comprise a second subset of higher-rate parameters for the current frame, wherein the second subset of higher-rate parameters for the current frame is used to generate the first adaptive contribution for the current frame.

4. The conversion entity defined in claim 3, wherein the first adaptive contribution for the current frame is generated further based on the first fixed contribution for the previous frame.

5. The conversion entity defined in claim 4, wherein the target excitation signal for the current frame is the sum of the first fixed contribution for the current frame and the first adaptive contribution for the current frame.

6. The conversion entity defined in claim 4, wherein the higher-rate speech parameters for the previous frame comprise a first subset of higher-rate parameters for the previous frame, and wherein the first subset of higher-rate parameters for the previous frame is used to generate the first fixed contribution for the previous frame.

7. The conversion entity defined in claim 6, wherein the dimmed excitation parameters for the current frame occupy fewer bits than the first subset of higher-rate parameters for the current frame.

8. The conversion entity defined in claim 7, wherein the first subset of higher-rate parameters for the current frame comprises a fixed codebook shape and a fixed codebook gain.

9. The conversion entity defined in claim 8, wherein the dimmed excitation parameters for the current frame comprise a second fixed codebook shape and a second fixed codebook gain.

10. The conversion entity defined in claim 9, wherein the second subset of higher-rate parameters for the current frame are also included in the lower-rate speech parameters for the current frame.

11. The conversion entity defined in claim 10, wherein the second subset of higher-rate speech parameters for the current frame comprises an adaptive codebook gain and a pitch lag.

12. The conversion entity defined in claim 1, wherein the second decoder is configured to operate in the first mode in the absence of a rate reduction request.

13. The conversion entity defined in claim 6, wherein the higher-rate speech parameters for the previous frame further comprise a second subset of higher-rate excitation parameters for the previous frame, and wherein the second subset of higher-rate excitation parameters for the previous frame is used to generate the second fixed contribution for the previous frame.

14. The conversion entity defined in claim 13, wherein said second subset of higher-rate speech parameters for the previous frame comprises an adaptive codebook gain and a pitch lag.

15. The conversion entity defined in claim 1, wherein said processing module comprises a vector quantizer and a comparator.

16. The conversion entity defined in claim 15, wherein said comparator is configured to determine a difference between the target excitation signal for the current frame and the second adaptive contribution for the current frame.

17. The conversion entity defined in claim 16, wherein said vector quantizer is configured to perform vector quantization to determine the dimmed excitation parameters for the current frame based on said difference.

18. The conversion entity defined in claim 17, wherein the dimmed excitation parameters for the current frame comprise a fixed codebook shape and a fixed codebook gain.

19. The conversion entity defined in claim 1, wherein the higher-rate speech parameters for the current frame are full-rate speech parameters and wherein the lower-rate speech parameters for the current frame are half-rate speech parameters.

20. The conversion entity defined in claim 1, wherein the higher-rate speech parameters for the current frame are not full-rate speech parameters or wherein the lower-rate speech parameters for the current frame are not half-rate speech parameters.

21. An apparatus comprising the conversion entity defined in claim 1, and a packetizing entity configured to insert the lower-rate speech parameters for the current frame into an output packet.

22. The apparatus defined in claim 21, wherein the packetizing entity is further configured to insert ancillary information into the output packet.

23. The apparatus defined in claim 22, the ancillary information comprising at least one of signaling information, overhead and enhanced forward error correction channel coding.

24. The apparatus defined in claim 22, the ancillary information comprising at least one of a text message, an instant message and an electronic mail message.

25. The conversion entity defined in claim 1, wherein the higher-rate speech parameters for the current frame comprise higher-rate parameters related to formant frequency content for the current frame, and wherein the lower-rate speech parameters for the current frame further comprise dimmed parameters related to formant frequency content for the current frame, the dimmed parameters related to formant frequency content for the current frame occupying fewer bits than the higher-rate parameters related to formant frequency content for the current frame.

26. The conversion entity defined in claim 25, further configured to produce said lower-rate parameters related to formant frequency content for the current frame from said higher-rate parameters related to formant frequency content for the current frame.

27. The conversion entity defined in claim 26, wherein said lower-rate parameters related to formant frequency content for the current frame are produced from said higher-rate parameters related to formant frequency content for the current frame without synthesizing a speech signal.

28. A conversion entity for converting higher-rate speech parameters for a current frame into lower-rate speech parameters for the current frame, the conversion entity comprising:

first means, for producing a respective target excitation signal for each of a series of frames including the current frame and a previous frame, the target excitation signal for a given frame being based on a respective first fixed contribution for the current frame and a respective first adaptive contribution for the given frame;

second means, for producing a second adaptive contribution for the current frame and further configured to selectably operate in a first mode or a second mode;

in the first mode, the second adaptive contribution for the current frame being generated based on the first fixed contribution for the previous frame;

in the second mode, the second adaptive contribution for the first frame being generated based on a second fixed contribution for the previous frame;

the second means being configured to operate in the second mode in response to a rate reduction request for the current frame;

third means, for determining dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate speech parameters for the current frame.

29. A computer readable storage medium storing computer-readable program code executable by a computing apparatus to cause the computing apparatus to execute a method of converting higher-rate speech parameters for a current frame into lower-rate speech parameters for the current frame, the computer-readable program code comprising:

first computer-readable program code for causing the computing apparatus to produce a respective target excitation signal for each of a series of frames including the current frame and a previous frame, the target excitation signal for a given frame being based on a respective first fixed contribution for the given frame and a respective first adaptive contribution for the given frame;

second computer-readable program code for causing the computing apparatus to produce a second adaptive contribution for the current frame in one of a first and a second mode;

in the first mode, the second adaptive contribution for the current frame being generated based on the first fixed contribution for the previous frame;

in the second mode, the second adaptive contribution for the current frame being generated based on a second fixed contribution for the previous frame;

wherein operation in said second mode is in response to a rate reduction request for the current frame;

third computer-readable program code for causing the computing apparatus to determine dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate speech parameters for the current frame.

30. A method of processing an original parametric representation of a current frame of speech, the original parametric representation of the current frame comprising higher-rate parameters related to formant frequency content and higher-rate parameters related to an excitation signal, the method comprising:

receiving a rate reduction request for the current frame;

producing lower-rate parameters related to formant frequency content by processing said higher-rate parameters related to formant frequency content without synthesizing formant frequency content from said higher-rate parameters related to formant frequency content;

producing lower-rate parameters related to an excitation signal by processing said higher-rate parameters related to an excitation signal without synthesizing formant frequency content from said higher-rate parameters related to formant frequency content;

outputting a dimmed parametric representation of the current frame comprising said lower-rate parameters related to formant frequency content and said lower-rate parameters related to an excitation signal;

the combination of said lower-rate parameters related to formant frequency content and said lower-rate parameters related to an excitation signal occupying fewer bits than the combination of said higher-rate parameters related to formant frequency content and said higher-rate parameters related to an excitation signal;

wherein said producing said lower-rate parameters related to an excitation signal comprises:

producing a respective target excitation signal for each of a series of frames including the current frame and a previous frame, the target excitation signal for a given frame being based on a respective first fixed contribution for the given frame and a respective first adaptive contribution for the given frame;

producing a second adaptive contribution for the current frame, wherein the second adaptive contribution for the current frame is generated either based on the first fixed contribution for the previous frame or, in response to said rate reduction request for the current frame, based on a second fixed contribution for the previous frame;

determining dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate parameters related to an excitation signal.

31. The method defined in claim 30, wherein said processing said higher-rate parameters related to an excitation signal comprises processing a version of the higher-rate parameters related to an excitation signal associated with the original parametric representation of the current frame.

32. The method defined in claim 30, wherein said processing said higher-rate parameters related to an excitation signal further comprises processing at least a version of the higher-rate parameters related to an excitation signal associated with a respective parametric representation of a previous frame.

33. The method defined in claim 30, wherein said producing said lower-rate parameters related to formant frequency content comprises executing a mapping.

34. A conversion entity for processing an original parametric representation of a current frame of speech, the original parametric representation of the current frame comprising higher-rate parameters related to formant frequency content and higher-rate parameters related to an excitation signal, the conversion entity comprising:

means for receiving a rate reduction request for the current frame;

means for producing lower-rate parameters related to formant frequency content by processing said higher-rate parameters related to formant frequency content without synthesizing formant frequency content from said higher-rate parameters related to formant frequency content;

means for producing lower-rate parameters related to an excitation signal by processing said higher-rate parameters related to an excitation signal without synthesizing formant frequency content from said higher-rate parameters related to formant frequency content;

means for outputting a dimmed parametric representation of the current frame comprising said lower-rate parameters related to formant frequency content and said lower-rate parameters related to an excitation signal;

wherein the combination of said lower-rate parameters related to formant frequency content and said lower-rate parameters related to an excitation signal occupies fewer bits than the combination of said higher-rate parameters related to formant frequency content and said higher-rate parameters related to an excitation signal;

wherein said means for producing said lower-rate parameters related to an excitation signal comprises:

means for producing a respective target excitation signal for each of a series of frames including the current frame and a previous frame, the target excitation signal for a given frame being based on a respective first fixed contribution for the given frame and a respective first adaptive contribution for the given frame;

means for producing a second adaptive contribution for the current frame, wherein the second adaptive contribution for the current frame is generated either based on the first fixed contribution for the previous frame or, in response to said rate reduction request for the current frame, based on a second fixed contribution for the previous frame;

means for determining dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate parameters related to an excitation signal.

35. A computer readable storage medium storing computer-readable program code executable by a computing apparatus to cause the computing apparatus to execute a method of processing an original parametric representation of a current frame of speech, the original parametric representation of the current frame comprising higher-rate parameters related to formant frequency content and higher-rate parameters related to an excitation signal, the computer-readable program code comprising:

first computer-readable program code for causing the computing apparatus to receive a rate reduction request for the current frame;

second computer-readable program code for causing the computing apparatus to produce lower-rate parameters related to formant frequency content by processing said higher-rate parameters related to formant frequency content without synthesizing formant frequency content from said higher-rate parameters related to formant frequency content;

third computer-readable program code for causing the computing apparatus to carry out production of lower-rate parameters related to an excitation signal by processing said higher-rate parameters related to an excitation signal without synthesizing formant frequency content from said higher-rate parameters related to formant frequency content;

fourth computer-readable program code for causing the computing apparatus to output a dimmed parametric representation of the current frame comprising said lower-rate parameters related to formant frequency content and said lower-rate parameters related to an excitation signal;

wherein the combination of said lower-rate parameters related to formant frequency content and said lower-rate parameters related to an excitation signal occupies fewer bits than the combination of said higher-rate parameters related to formant frequency content and said higher-rate parameters related to an excitation signal;

wherein said production of lower-rate parameters related to an excitation signal comprises:

producing a respective target excitation signal for each of a series of frames including the current frame and a previous frame, the target excitation signal for a given frame being based on a respective first fixed contribution for the given frame and a respective first adaptive contribution for the given frame;

producing a second adaptive contribution for the current frame, wherein the second adaptive contribution for the current frame is generated either based on the first fixed contribution for the previous frame or, in response to said rate reduction request for the current frame, based on a second fixed contribution for the previous frame;

determining dimmed excitation parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame;

wherein the dimmed excitation parameters for the current frame are included in the lower-rate parameters related to an excitation signal.

36. A method of converting higher-rate speech parameters for a current frame into lower-rate speech parameters for the current frame, comprising:

producing a respective target excitation signal for each of a series of frames including the current frame and a previous frame, the target excitation signal for a given frame being based on a respective first fixed contribution for the given frame and a respective first adaptive contribution for the given frame;

producing a second adaptive contribution for the current frame in one of a first and a second mode;

in the first mode, the second adaptive contribution for the current frame being generated based on the first fixed contribution for the previous frame;

in the second mode, the second adaptive contribution for the current frame being generated based on a second fixed contribution for the previous frame;

wherein operation in said second mode is in response to a rate reduction request for the current frame;

determining dimmed excitation parameters for the current frame, the dimmed excitation parameters for the current frame being included in the lower-rate speech parameters for the current frame, the dimmed excitation parameters for the current frame being generated based on the target excitation signal for the current frame and the second adaptive contribution for the current frame, the dimmed excitation parameters for the current frame being used to generate a second fixed contribution for the current frame.

* * * * *

UNITED STATES PATENT AND TRADEMARK OFFICE

CERTIFICATE OF CORRECTION

PATENT NO. : 7,725,311 B2
APPLICATION NO. : 11/536261
DATED : May 25, 2010
INVENTOR(S) : Bourokba et al.

It is certified that error appears in the above-identified patent and that said Letters Patent is hereby corrected as shown below:

In Column 11, Line 57, delete "Excitational" and insert -- Excitation --, therefor.

Signed and Sealed this

Second Day of November, 2010

David J. Kappos

David J. Kappos
*Director of the United States Patent and Trademark Office*